US010247016B2

(12) United States Patent
Kawashita et al.

(10) Patent No.: US 10,247,016 B2
(45) Date of Patent: Apr. 2, 2019

(54) STEAM TURBINE

(71) Applicant: MITSUBISHI HITACHI POWER SYSTEMS, LTD., Yokohama (JP)

(72) Inventors: Rimpei Kawashita, Tokyo (JP); Tamiaki Nakazawa, Tokyo (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 404 days.

(21) Appl. No.: 15/112,518

(22) PCT Filed: Mar. 23, 2015

(86) PCT No.: PCT/JP2015/058700
§ 371 (c)(1),
(2) Date: Jul. 19, 2016

(87) PCT Pub. No.: WO2015/146895
PCT Pub. Date: Oct. 1, 2015

(65) Prior Publication Data

US 2016/0356166 A1 Dec. 8, 2016

(30) Foreign Application Priority Data

Mar. 24, 2014 (JP) ..... 2014-060243

(51) Int. Cl.
*F01D 9/04* (2006.01)
*F01D 25/30* (2006.01)

(52) U.S. Cl.
CPC ..... *F01D 9/04* (2013.01); *F01D 25/30* (2013.01); *F05D 2220/31* (2013.01);
(Continued)

(58) Field of Classification Search
CPC .. F01D 9/04; F05D 2240/12; F05D 2250/232; F02C 7/20
See application file for complete search history.

(56) References Cited

U.S. PATENT DOCUMENTS 4,900,223 A * 2/1990 Groenendaal, Jr. ..... F01D 9/04 415/103
5,257,906 A * 11/1993 Gray ..... F01D 25/30 415/211.2

(Continued)

FOREIGN PATENT DOCUMENTS

CN 1286739 3/2001
CN 1294248 5/2001

(Continued)

OTHER PUBLICATIONS

International Search Report dated Jun. 23, 2015 in corresponding International Application No. PCT/JP2015/058700.

(Continued)

*Primary Examiner* — Ninh H. Nguyen
(74) *Attorney, Agent, or Firm* — Wenderoth, Lind & Ponack, L.L.P.

(57) ABSTRACT

A steam turbine includes a flow guide placed about a rotor shaft and forming a side wall of a diffuser. The flow guide is formed in such a substantially truncated conical shape that a first portion having a semi-circular-arc cross section and a second portion having a semi-circular-arc cross section and exhibiting less thermal deformation than the first portion are combined together. A coupling portion of the first portion with the second portion has a first protrusion protruding, in the circumferential direction thereof, more on a rotor shaft side than on a steam flow path side of the diffuser. A coupling portion of the second portion with the first portion has a second protrusion protruding, in the circumferential direction thereof, more on the steam flow path side of the diffuser than on the rotor shaft side and overlapping with the first protrusion in the radial direction of the flow guide.

8 Claims, 6 Drawing Sheets

(52) U.S. Cl.
CPC .. *F05D 2230/642* (2013.01); *F05D 2240/128* (2013.01); *F05D 2240/60* (2013.01); *F05D 2250/232* (2013.01); *F05D 2260/38* (2013.01)

(56) References Cited

U.S. PATENT DOCUMENTS

| | | | | |
|---|---|---|---|---|
| 6,244,816 | B1 | 6/2001 | Magoshi | |
| 6,345,953 | B1 | 2/2002 | Henkel et al. | |
| 6,602,046 | B2 * | 8/2003 | Kraus | F01D 25/04 415/1 |
| 8,475,124 | B2 * | 7/2013 | Dalsania | F01D 9/06 415/207 |
| 2013/0084162 | A1 | 4/2013 | Sano et al. | |
| 2014/0047813 | A1 | 2/2014 | Frailich et al. | |
| 2014/0119910 | A1 | 5/2014 | Koza et al. | |

FOREIGN PATENT DOCUMENTS

| | | |
|---|---|---|
| JP | 61-135906 | 6/1986 |
| JP | 11-93614 | 4/1999 |
| JP | 2000-80904 | 3/2000 |
| JP | 2008-144617 | 6/2008 |
| JP | 2011-202570 | 10/2011 |
| JP | 2011-226428 | 11/2011 |
| JP | 2012-202247 | 10/2012 |
| JP | 2013-83250 | 5/2013 |

OTHER PUBLICATIONS

First Office Action dated Jan. 25, 2017 in corresponding Chinese Application No. 201580005518.7 (with English translation).
Office Action dated Jan. 11, 2019 in corresponding German Application No. 112015001412.8 (with partial English translation).

* cited by examiner

STEAM TURBINE

TECHNICAL FIELD

The present invention relates to a steam turbine configured to use steam to generate rotational power.

BACKGROUND ART

A steam turbine using operation steam to generate rotational power is formed in such a manner that a rotor shaft, an upper-half casing, and a lower-half casing are assembled together. Moreover, the steam turbine is provided with a diffuser (an enlarged flow path) formed to reduce an exhaust loss of the operation steam having been used for rotational power generation to exhaust the operation steam to the outside of the casing (see PTL 1). When the steam turbine is placed, a lower-half inner chamber and a lower-half outer chamber to which a lower-half flow guide is fixed are first placed on a foundation. Then, the rotor shaft to which a plurality of moving blades are fixed is placed rotatably about an axis. Subsequently, an upper-half inner chamber and an upper-half outer chamber to which an upper-half flow guide is fixed are fixed to the lower-half outer chamber.

CITATION LIST

Patent Literature

{PTL 1}
Japanese Unexamined Patent Application, Publication No. 2011-226428

SUMMARY OF INVENTION

Technical Problem

A flow guide (a truncated cone) of the steam turbine forms a rotor shaft side wall of the diffuser, and is attached about the rotor shaft to prevent wake turbulence of a last-stage blade to smoothly exhaust steam. Upper and lower halves of the flow guide are, on the steam flow downstream side, coupled to an outer chamber with bolts. Moreover, at the tip end portion of the flow guide on the steam flow upstream side (the blade side), the upper and lower halves of the flow guide are coupled together with bolts at two points.

However, bolt coupling of the flow guide on the steam flow upstream side can be made after the upper-half outer chamber is placed on the lower-half outer chamber. Thus, there is no access to the bolt-coupled position from the outside of the upper-half outer chamber, and for this reason, an access from a condenser side below the steam turbine is required. Since the steam turbine is placed on an upper portion of the foundation, bolt coupling of the flow guide is performed at a high altitude. This requires a scaffold assembled in the foundation, leading to a low working efficiency. In order to improve workability, it has been demanded to omit bolt coupling of the flow guide on the steam flow upstream side.

In the case of omitting such bolt coupling, the upper and lower halves of the flow guide are in a separate state on the steam flow upstream side of the flow guide. Thus, the natural frequency of the flow guide is lowered, and there is a risk that the flow guide resonates with the frequency once or twice as high as the rotational speed of the steam turbine. Further, since the high-pressure steam for sealing between the rotor shaft and the outer chamber flows inside (the rotor shaft side) the flow guide, the temperature of the flow guide is higher on the inside than on the outside (the flow path side of the diffuser). Thus, on the steam flow upstream side of the flow guide, there is the problem that an arc cross section of the upper or lower half of the flow guide might be deformed and expanded, the upper and lower halves might be deformed away from each other to open in the vertical direction, so that the upper and lower halves of the flow guide are separated from each other.

The present invention has been made in view of the above-described situation, and is intended to provide a steam turbine for which assembly of a flow guide is facilitated and which is capable of maintaining unity of upper and lower halves of the flow guide even in operation.

Solution to Problem

The steam turbine of the present invention includes a flow guide placed about a rotor shaft and forming a side wall of a diffuser close to the rotor shaft. The flow guide is formed in such a substantially truncated conical shape that a first portion having a semi-circular-arc cross section and a second portion having a semi-circular-arc cross section and exhibiting less thermal deformation than the first portion are combined together. A coupling portion of the first portion with the second portion has a first protrusion protruding, in the circumferential direction thereof, more on a rotor shaft side than on a steam flow path side of the diffuser. A coupling portion of the second portion with the first portion has a second protrusion protruding, in the circumferential direction thereof, more on the steam flow path side of the diffuser than on the rotor shaft side and overlapping with the first protrusion in the radial direction of the flow guide.

According to such a configuration, the second portion is less thermally deformable than the first portion. Thus, when the temperature of the flow guide becomes higher on the rotor shaft side than on the diffuser side, the first protrusion of the first portion is pressed against the second protrusion of the second portion from the inside to the outside. In this state, the first and second portions overlap with each other in the radial direction thereof at the first and second protrusions. This can prevent separation of the first and second portions. Thus, unity of the first and second portions can be maintained without using a fastening member for fastening the first and second portions together.

In the above-described aspect of the invention, the thickness of the second portion may be greater than that of the first portion.

According to such a configuration, when the temperature of the flow guide becomes higher on the rotor shaft side than on the diffuser side, the second portion having a greater thickness exhibits less thermal deformation than the first portion.

The steam turbine of the above-described aspect of the invention may further include a restraining member connected to the inner surface of the second portion on the rotor shaft side such that the second portion exhibits less thermal deformation than the first portion.

According to such a configuration, when the temperature of the flow guide becomes higher on the rotor shaft side than on the diffuser side, the restraining member causes the second portion to exhibit less thermal deformation than the first portion.

In the above-described aspect of the invention, the restraining member may have a planar member forming a space between the planar member and the second portion.

According to such a configuration, the planar member and the space between the second portion and the planar member can reduce the heat transferred from the rotor shaft side to the second portion, and as a result, thermal deformation of the second portion can be reduced as compared to the first portion.

Advantageous Effects of Invention

According to the present invention, the fastening member for coupling the upper and lower halves together can be omitted. Thus, assembly of the flow guide can be facilitated. In addition, the first and second protrusions overlap with each other in the radial direction thereof, and therefore, unity of the upper and lower halves of the flow guide can be maintained even in operation.

DESCRIPTION OF EMBODIMENTS

<First Embodiment>

Figure 1:
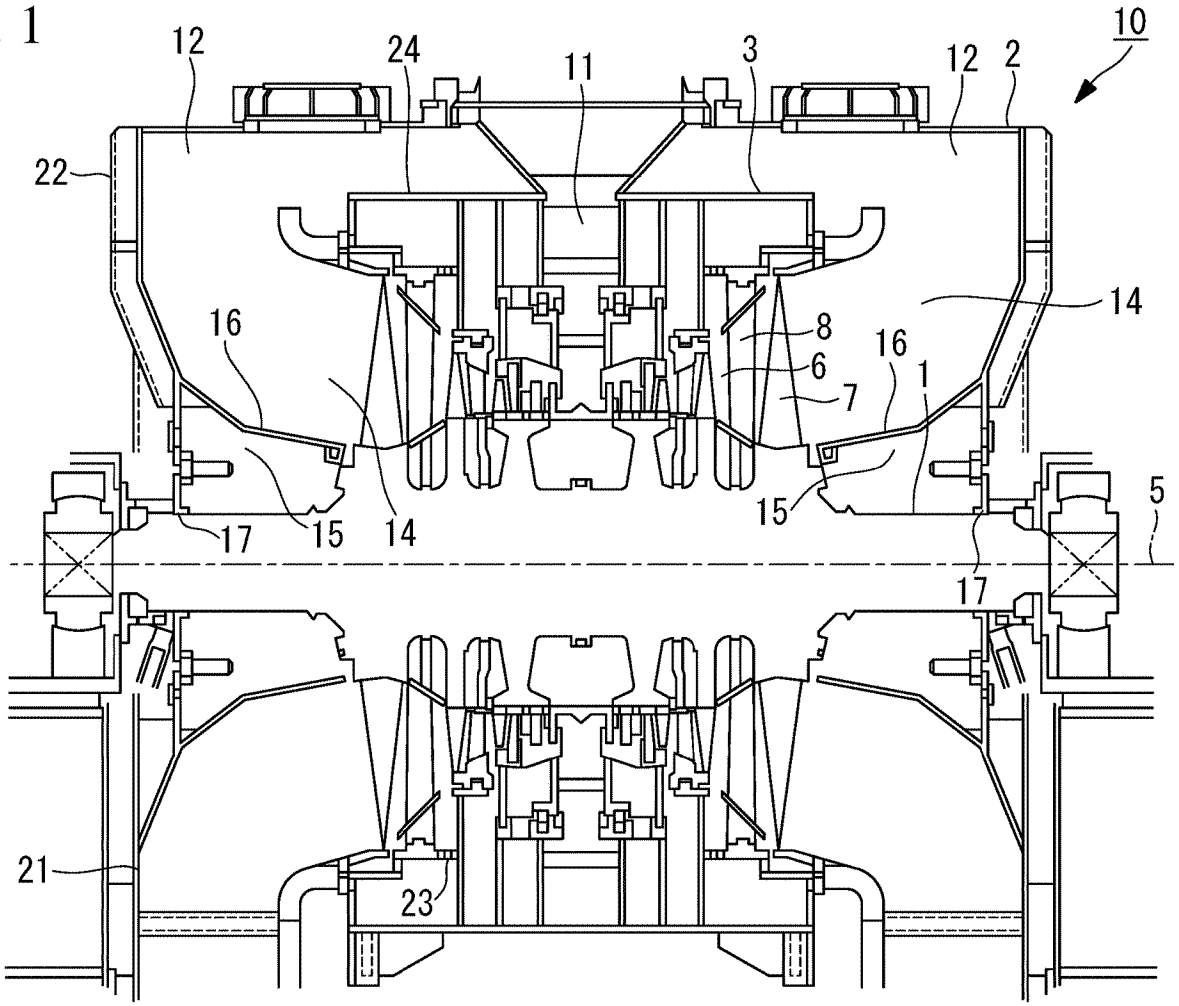
FIG. 1 is a cross-sectional view of a steam turbine of a first embodiment of the present invention.

A steam turbine of a first embodiment of the present invention will be described with reference to drawings. As illustrated in FIG. 1, a steam turbine 10 includes a rotor shaft 1, an outer chamber 2, and an inner chamber 3. The rotor shaft 1 is supported by a bearing rotatably about an axis 5 along the horizontal direction. The outer chamber 2 is formed to surround the rotor shaft 1, and is fixed to a foundation. The inner chamber 3 is disposed inside the outer chamber 2 to surround the rotor shaft 1, and is fixed to the outer chamber 2. A main flow path 6 is formed between the rotor shaft 1 and the inner chamber 3 to surround the rotor shaft 1.

The steam turbine 10 further includes a plurality of moving blades 7 and a plurality of stationary blades 8. Each moving blade 7 is fixed to the rotor shaft 1, and is disposed in the main flow path 6. When steam flows through the main flow path 6, the moving blades 7 rotate the rotor shaft 1 about the axis 5. Each stationary blade 8 is fixed to the inner chamber 3, and is disposed in the main flow path 6. The stationary blades 8 guide the steam flowing through the main flow path 6 to the moving blades 7 to rotate the rotor shaft 1.

The outer chamber 2 and the inner chamber 3 form a steam supply port 11, a steam discharge chamber 12, a diffuser 14, and a flow guide shaft-side space 15. The steam supply port 11 is formed at an upper center portion of the outer chamber 2. The steam supply port 11 supplies the center of the main flow path 6 with the steam supplied from external upstream equipment (e.g., a boiler) to the steam turbine 10. The steam discharge chamber 12 is formed to surround the rotor shaft 1 and to surround the ends of the main flow path 6. The steam discharge chamber 12 supplies an external condenser with the stream having flowed through the main flow path 6. The diffuser 14 is formed to surround the rotor shaft 1, and is formed between a steam-flow-downstream end portion of the main flow path 6 and the steam discharge chamber 12. The temperature of the stream flowing through the diffuser 14 is about several tens of degrees. The diffuser 14 supplies the steam discharge chamber 12 with the stream having flowed through the main flow path 6. The diffuser 14 is formed such that a flow path cross section thereof increases with a distance from the main flow path 6 to reduce an exhaust loss of the steam flowing through the diffuser 14. This can highly efficiently generate rotational power. The flow guide shaft-side space 15 is formed between the diffuser 14 and the rotor shaft 1.

The steam turbine 10 further includes a flow guide 16 and a gland seal 17. The flow guide 16 is disposed between the diffuser 14 and the flow guide shaft-side space 15 on the inside of the outer chamber 2, and is fixed to the outer chamber 2. The flow guide 16 forms a side wall of the diffuser 14 on the side close to the rotor shaft 1, and separates the diffuser 14 and the flow guide shaft-side space 15 from each other. The gland seal 17 is formed between the rotor shaft 1 and the outer chamber 2, and seals the flow guide shaft-side space 15 and the outside of the outer chamber 2. The steam turbine 10 further includes a not-shown gland steam supply path. The gland steam supply path supplies the gland seal 17 with gland steam as high-temperature high-pressure steam, and the gland steam leaks to the outside and the flow guide shaft-side space 15.

The outer chamber 2 is formed to be dividable into a lower-half outer chamber 21 and an upper-half outer chamber 22 substantially along the horizontal plane containing the axis 5. The inner chamber 3 is formed to be dividable into a lower-half inner chamber 23 and an upper-half inner chamber 24 along the horizontal plane containing the axis 5.

Figure 2:
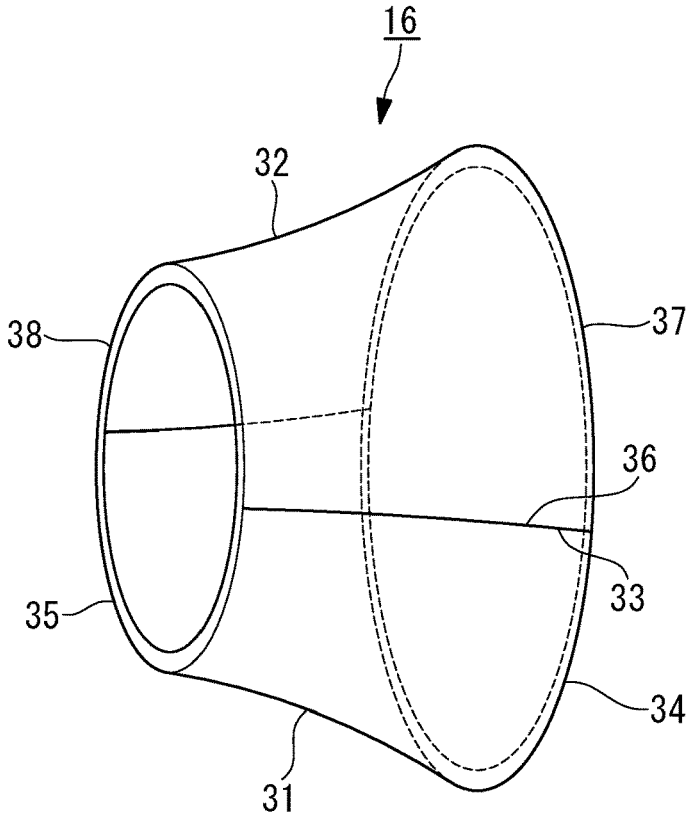
FIG. 2 is a perspective view of a flow guide of the steam turbine of the first embodiment of the present invention.

As illustrated in FIG. 2, the flow guide 16 is formed substantially along a side surface of a substantially truncated cone. The flow guide 16 includes a lower-half flow guide 31 and an upper-half flow guide 32. The lower-half flow guide 31 and the upper-half flow guide 32 are examples of first and second portions, respectively. The lower-half flow guide 31 is disposed below the horizontal plane containing the axis 5. The upper-half flow guide 32 is disposed above the horizontal plane containing the axis 5.

The lower-half flow guide 31 is formed of a plate-shaped member having a substantially semi-circular-arc cross section along the direction perpendicular to the axis. The lower-half flow guide 31 is provided with a lower-half flow guide coupling portion 33, a lower-half flow guide large-diameter end 34, and a lower-half flow guide small-diameter end 35. As in the lower-half flow guide 31, the upper-half flow guide 32 is formed of a plate-shaped member having a substantially semi-circular-arc cross section. The upper-half flow guide 32 is provided with an upper-half flow guide coupling portion 36, an upper-half flow guide large-diameter end 37, and an upper-half flow guide small-diameter end 38. The lower-half flow guide coupling portion 33 and the upper-half flow guide coupling portion 36 are each formed to have the surface parallel to the horizontal plane containing the axis 5.

The lower-half flow guide large-diameter end 34, the upper-half flow guide large-diameter end 37, the lower-half flow guide small-diameter end 35, and the upper-half flow guide small-diameter end 38 are formed on the plane perpendicular to the axis 5, and the circumferential direction of these ends is along a circle about the axis 5. The radius of the circle formed by the lower-half flow guide large-diameter end 34 and the upper-half flow guide large-diameter end 37 is greater than the radius of the circle formed by the lower-half flow guide small-diameter end 35 and the upper-half flow guide small-diameter end 38. The flow guide 16 is disposed such that the lower-half flow guide small-diameter end 35 and the upper-half flow guide small-diameter end 38 are positioned close to the main flow path 6, i.e., on the steam flow upstream side. The flow guide 16 is configured such that on the steam flow downstream side, the lower-half flow guide large-diameter end 34 is coupled to the lower-half outer chamber 21 and the upper-half flow guide large-diameter end 37 is coupled to the upper-half outer chamber 22.

Figure 3:
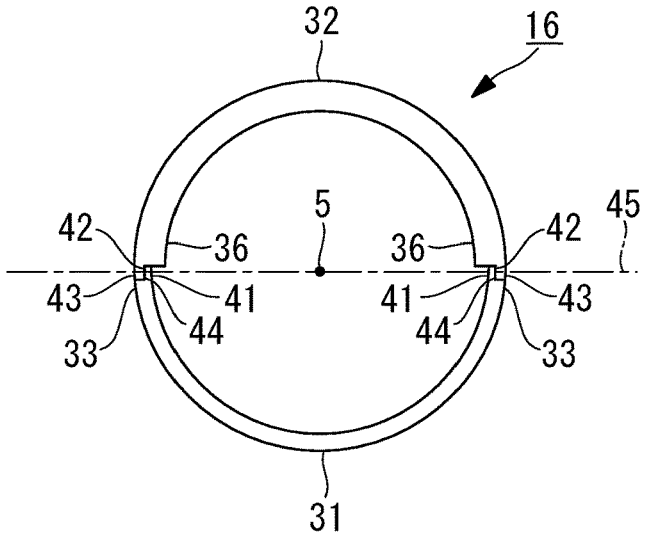
FIG. 3 is a front view of the flow guide of the steam turbine of the first embodiment of the present invention.

As illustrated in FIG. 3, the thickness of the upper-half flow guide 32 is greater than that of the lower-half flow guide 31. Thus, the upper-half flow guide 32 is less thermally deformed as compared to the lower-half flow guide 31 when the flow guide 16 is more heated on the inside than on the outside.

An inner step portion 41 is formed at the lower-half flow guide coupling portion 33 of the lower-half flow guide 31. The inner step portion 41 is an example of a first protrusion. The inner step portion 41 protrudes, in the circumferential direction thereof, more on the side of the lower-half flow guide 31 close to the rotor shaft 1 than the side of the lower-half flow guide 31 close to a steam flow path of the diffuser 14. The inner step portion 41 is provided with a contact surface 42. The contact surface 42 faces the side opposite to the axis 5.

An outer step portion 43 is formed at the upper-half flow guide coupling portion 36 of the upper-half flow guide 32. The outer step portion 43 is an example of a second protrusion. The outer step portion 43 protrudes, in the circumferential direction thereof, more on the side of the upper-half flow guide 32 close to the steam flow path of the diffuser 14 than on the side of the upper-half flow guide 32 close to the rotor shaft 1. The outer step portion 43 is provided with a contact surface 44. The contact surface 44 is formed to face the axis 5. The contact surface 42 and the contact surface 44 are each formed in the vertical plane substantially perpendicular to the horizontal plane 45 containing the axis 5. The flow guide 16 is formed such that the contact surface 42 of the lower-half flow guide 31 contacts the contact surface 44 of the upper-half flow guide 32 and that the inner step portion 41 is caught by the outer step portion 43.

In operation of the steam turbine 10, a gland steam of 100° C. to 150° C. is supplied to the flow guide shaft-side space 15 such that the pressure in the flow guide shaft-side space 15 reaches greater than an atmospheric air pressure.

Since the temperature of the gland steam leaking to the flow guide shaft-side space 15 is higher than that of the steam flowing through the main flow path 6, the temperature of the flow guide 16 is higher on the inside than on the outside. As described above, the lower-half flow guide 31 and the upper-half flow guide 32 are, on the steam flow downstream side, coupled respectively to the lower-half outer chamber 21 and the upper-half outer chamber 22. Thus, when the inside of the flow guide 16 is more heated as compared to the outside of the flow guide 16, the lower-half flow guide 31 and the upper-half flow guide 32 deform to separate from each other on the steam flow upstream side of the flow guide 16.

Figure 4:
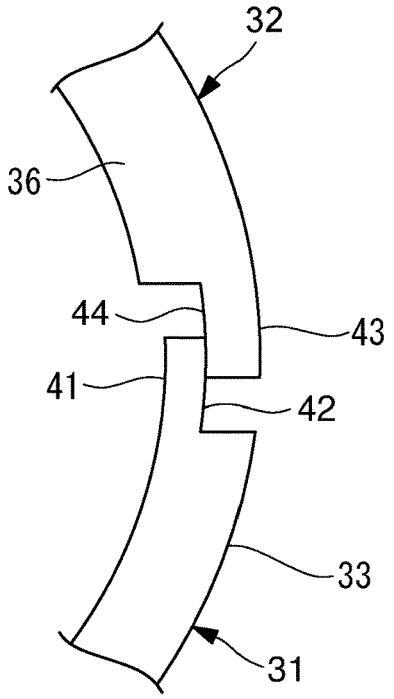
FIG. 4 is a front view of thermal deformation of the flow guide of the steam turbine of the first embodiment of the present invention.

In such a state, the lower-half flow guide 31 exhibits greater thermal deformation than the upper-half flow guide 32. As a result, the contact surface 42 of the lower-half flow guide 31 is pressed against the contact surface 44 of the upper-half flow guide 32. As illustrated in FIG. 4, the flow guide 16 is in such a state that the lower-half flow guide 31 and the upper-half flow guide 32 overlap with each other in the radial direction thereof at the inner step portion 41 and the outer step portion 43.

Figure 5:
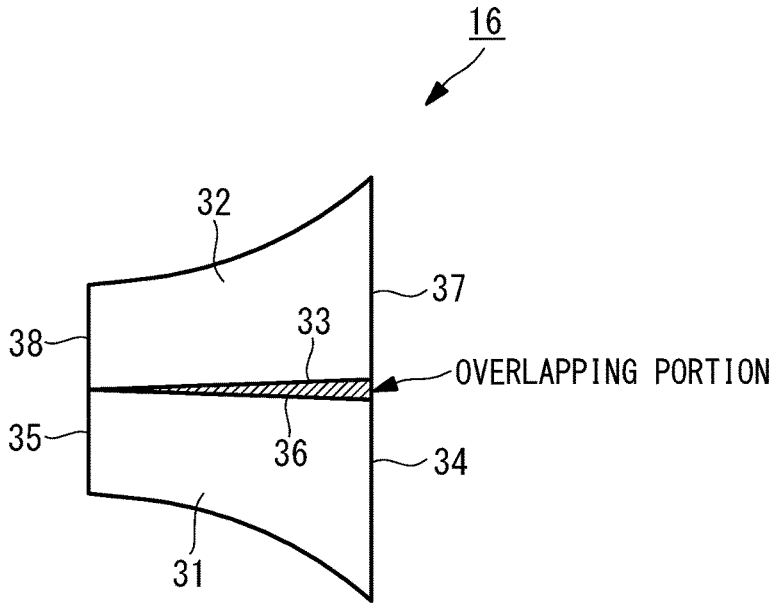
FIG. 5 is a side view of thermal deformation of the flow guide of the steam turbine of the first embodiment of the present invention.

Thus, when the flow guide 16 is heated by steam of the flow guide shaft-side space 15, the lower-half flow guide 31 and the upper-half flow guide 32 do not separate from each other particularly at the lower-half flow guide small-diameter end 35 and the upper-half flow guide small-diameter end 38, as illustrated in FIG. 5. Thus, in operation of the steam turbine, the steam flow path of the diffuser 14 can remain in a suitable shape.

The flow guide 16 can be more easily formed as compared to a typical flow guide without the need for fastening the lower-half flow guide 31 and the upper-half flow guide 32 with a fastening member.

Figure 6:
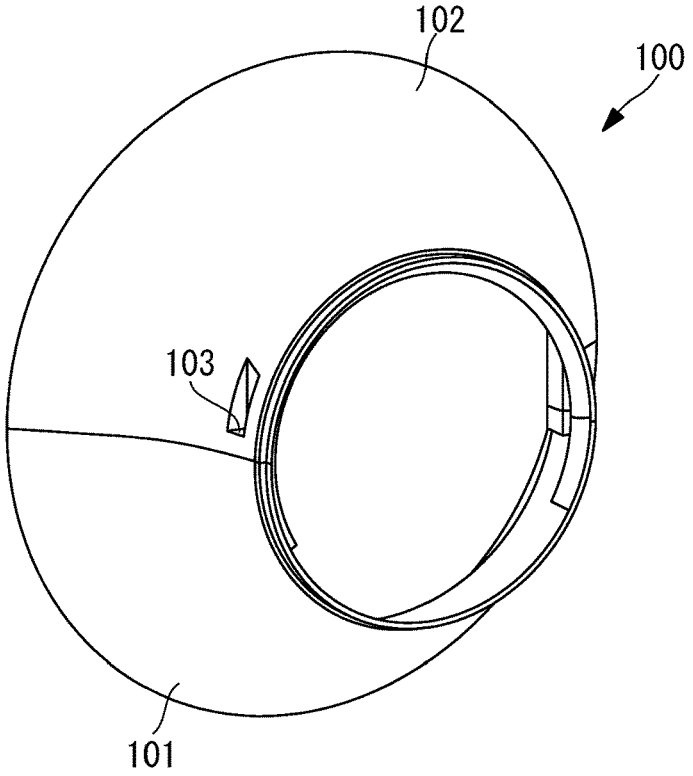
FIG. 6 is a perspective view of a flow guide of a typical example.

As illustrated in FIG. 6, a typical example of a steam turbine is configured such that the flow guide 16 of the steam turbine 10 of the above-described first embodiment is replaced with another flow guide. As illustrated in FIG. 6, the flow guide 100 includes a lower-half flow guide 101, an upper-half flow guide 102, and a fastening member 103. The flow guide 100 is formed in such a manner that the lower-half flow guide 101 and the upper-half flow guide 102 are fastened using the fastening member 103.

When the steam turbine of the typical example is placed, an upper-half outer chamber 22 is fixed to a lower-half outer chamber 21, and then, a scaffold is placed inside a foundation. A worker supported by the scaffold uses the fastening member 103 to fasten the lower-half flow guide 101 and the upper-half flow guide 102. The scaffold is removed after the lower-half flow guide 101 and the upper-half flow guide 102 have been fastened together.

For the steam turbine 10, it is not necessary to place and remove a scaffold used in fastening of the lower-half flow guide 31 and the upper-half flow guide 32. The steam turbine 10 can be more easily formed as compared to the steam turbine of the typical example.

<Second Embodiment>

Figure 7:
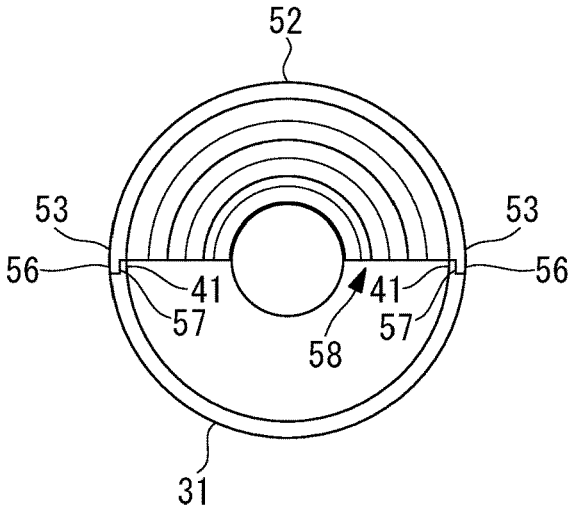
FIG. 7 is a front view of a flow guide of a steam turbine of a second embodiment of the present invention.

In a second embodiment of the steam turbine, the upper-half flow guide 32 of the flow guide 16 of the above-described first embodiment is replaced with another upper-half flow guide. As in the upper-half flow guide 32, the upper-half flow guide 52 is provided with an upper-half flow guide coupling portion 53, an upper-half flow guide large-diameter end 54, and an upper-half flow guide small-diameter end 55. As illustrated in FIG. 7, an outer step portion 56 is formed at the upper-half flow guide coupling portion 53 of the upper-half flow guide 52. The outer step portion 56 is provided with a contact surface 57. The contact surface 57 is formed to face a contact surface 42 of a lower-half flow guide 31.

Figure 8:
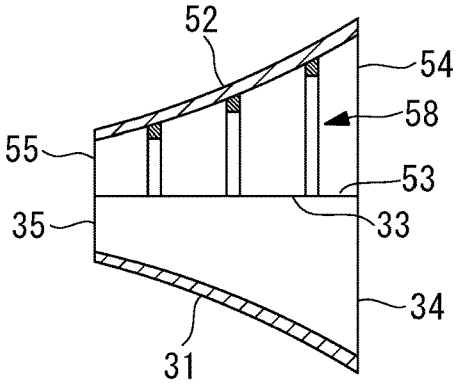
FIG. 8 is a cross-sectional view of the flow guide of the steam turbine of the second embodiment of the present invention.

As illustrated in FIGS. 7 and 8, the upper-half flow guide 52 further includes a plurality of ribs 58. Each rib 58 is formed in a substantially semi-circular-arc shape. The ribs 58 are, in the plane perpendicular to the axis 5, arranged to contact the inner surface of the upper-half flow guide 52 in the circumferential direction thereof, and are connected to the upper-half flow guide 52. With the ribs 58, the upper-half flow guide 52 is less thermally deformed as compared to the lower-half flow guide 31 in the case of the upper-half flow guide 52 having a thickness less than that of the lower-half flow guide 31.

When the flow guide including the upper-half flow guide 52 is heated by steam of a flow guide shaft-side space 15, the upper-half flow guide 52 is less thermally deformed as compared to the lower-half flow guide 31. As in the flow guide 16 of the above-described first embodiment, the contact surface 42 is pressed against the contact surface 57. In this state, the lower-half flow guide 31 and the upper-half flow guide 52 overlap with each other in the radial direction thereof at an inner step portion 41 and the outer step portion 56.

<Third Embodiment>

Figure 9:
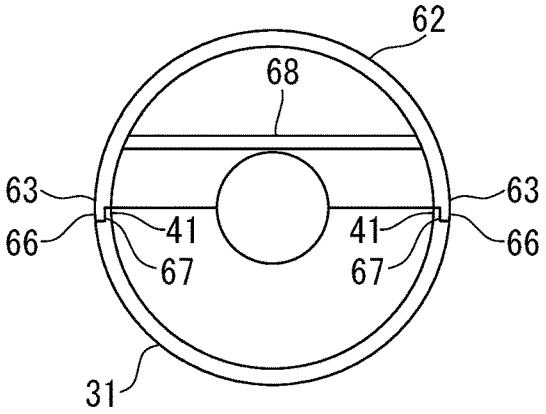
FIG. 9 is a front view of a flow guide of a steam turbine of a third embodiment of the present invention.

In a third embodiment of the steam turbine, the upper-half flow guide 32 of the flow guide 16 of the above-described first embodiment is further replaced with another upper-half flow guide. As in the upper-half flow guide 32, the upper-half flow guide 62 is provided with an upper-half flow guide coupling portion 63, an upper-half flow guide large-diameter end 64, and an upper-half flow guide small-diameter end 65. As illustrated in FIG. 9, an outer step portion 66 is formed at the upper-half flow guide coupling portion 63 of the upper-half flow guide 62. The outer step portion 66 is provided with a contact surface 67. The contact surface 67 is formed to face a contact surface 42.

Figure 10:
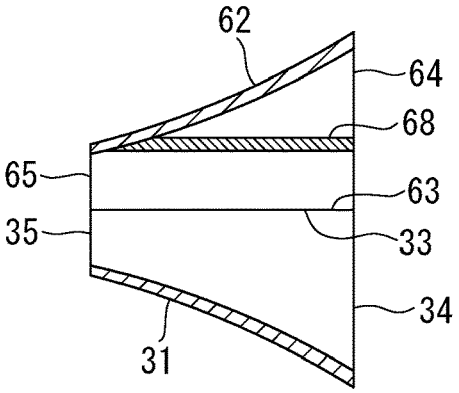
FIG. 10 is a cross-sectional view of the flow guide of the steam turbine of the third embodiment of the present invention.

As illustrated in FIGS. 9 and 10, the upper-half flow guide 62 further includes a partitioning plate 68. The partitioning plate 68 is formed in a flat plate shape. The partitioning plate 68 is disposed inside the upper-half flow guide 62 so as not to contact a rotor shaft 1 and so as to be parallel to the horizontal plane containing an axis 5, and is connected to the inner surface of the upper-half flow guide 62. With the partitioning plate 68, the upper-half flow guide 62 is less thermally deformed as compared to a lower-half flow guide 31 in the case of the upper-half flow guide 62 having a thickness less than that of the lower-half flow guide 31.

When the flow guide including the upper-half flow guide 62 is heated by steam of a flow guide shaft-side space 15, the upper-half flow guide 62 is less thermally deformed as compared to the lower-half flow guide 31. As in the flow guide 16 of the above-described first embodiment, the contact surface 42 is pressed against the contact surface 67. In this state, the lower-half flow guide 31 and the upper-half flow guide 62 overlap with each other in the radial direction thereof at an inner step portion 41 and an outer step portion 56.

<Fourth Embodiment>

Figure 11:
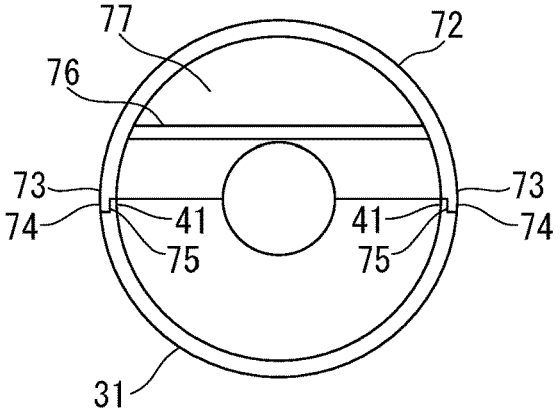
FIG. 11 is a front view of a flow guide of a steam turbine of a fourth embodiment of the present invention.
Figure 12:
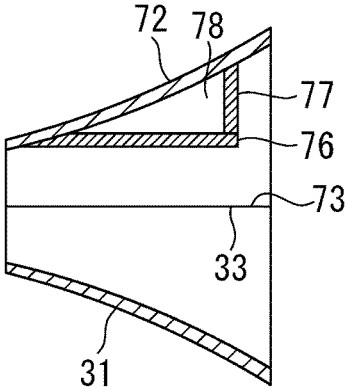
FIG. 12 is a cross-sectional view of the flow guide of the steam turbine of the fourth embodiment of the present invention.

In a fourth embodiment of the steam turbine, the upper-half flow guide 32 of the flow guide 16 of the above-described first embodiment is further replaced with another upper-half flow guide. As in the upper-half flow guide 32, the upper-half flow guide 72 is provided with an upper-half flow guide coupling portion 73, an upper-half flow guide large-diameter end 64, and an upper-half flow guide small-diameter end 65. As illustrated in FIG. 11, an outer step portion 74 is formed at the upper-half flow guide coupling portion 73 of the upper-half flow guide 72. The outer step portion 74 is provided with a contact surface 75. The contact surface 75 is formed to face a contact surface 42.

The upper-half flow guide 72 further includes a partitioning plate 76 and a side wall 77. The partitioning plate 76 is formed in a flat plate shape. The partitioning plate 76 is disposed inside the upper-half flow guide 72 so as not to contact a rotor shaft 1 and so as to be parallel to the horizontal plane containing an axis 5, and is connected to the inner surface of the upper-half flow guide 72. The side wall 77 is formed of a plate-shaped member, and is connected such that the edge of the side wall 77 contacts, in the circumferential direction thereof, the end of the partitioning plate 76 close to the upper-half flow guide large-diameter end 64 and the inner side of the upper-half flow guide 72. That is, a space 78 surrounded by the upper-half flow guide 72, the partitioning plate 76, and the side wall 77 is formed in the upper-half flow guide 72. The partitioning plate 76 and the space 78 reduce the heat transferred from the steam supplied to a flow guide shaft-side space 15 to the upper-half flow guide 72. With the partitioning plate 76 and the space 78, the upper-half flow guide 72 is less thermally deformed as compared to a lower-half flow guide 31 in the case of the upper-half flow guide 72 having a thickness less than that of the lower-half flow guide 31.

When the flow guide including the upper-half flow guide 72 is heated by steam of the flow guide shaft-side space 15, the upper-half flow guide 72 is less thermally deformed as compared to the lower-half flow guide 31. As in the flow guide 16 of the above-described first embodiment, the contact surface 42 is pressed against the contact surface 75. In this state, the lower-half flow guide 31 and the upper-half flow guide 72 overlap with each other in the radial direction thereof at an inner step portion 41 and an outer step portion 74.

<Fifth Embodiment>

Figure 13:
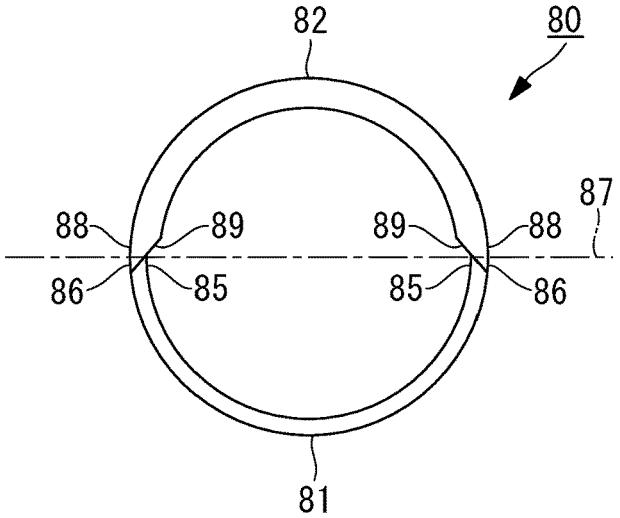
FIG. 13 is a front view of a flow guide of a steam turbine of a fifth embodiment of the present invention.

In a fifth embodiment of the steam turbine, the flow guide 16 of the above-described first embodiment is replaced with another flow guide. As in the flow guide 16, the flow guide 80 includes a lower-half flow guide 81 and an upper-half flow guide 82, as illustrated in FIG. 13. The thickness of the upper-half flow guide 82 is greater than that of the lower-half flow guide 81. Thus, when the inside of the flow guide 80 is heated, the upper-half flow guide 82 is less thermally deformed as compared to the lower-half flow guide 81.

At a coupling portion between the lower-half flow guide 81 and the upper-half flow guide 82, the lower-half flow guide 81 is provided with an inner protrusion 85. The inner protrusion 85 is provided with a contact surface 86. The contact surface 86 is formed in the plane intersecting the horizontal plane 87 containing an axis 5 at a predetermined angle (e.g., 45 degrees). At the coupling portion between the upper-half flow guide 82 and the lower-half flow guide 81, the upper-half flow guide 82 is provided with an outer protrusion 88. The outer protrusion 88 is provided with a contact surface 89. The contact surface 89 is formed to face the contact surface 86. The inner protrusion 85 and the outer protrusion 88 are examples of first and second protrusions, respectively.

When the flow guide 80 is heated by steam of a flow guide shaft-side space 15, the upper-half flow guide 82 is less thermally deformed as compared to the lower-half flow guide 81. As in the flow guide 16 of the above-described first embodiment, the contact surface 86 is pressed against the contact surface 89. In this state, the lower-half flow guide 81 and the upper-half flow guide 82 overlap with each other in the radial direction thereof at the inner protrusion 85 and the outer protrusion 88.

Note that the upper-half flow guide 82 can be less thermally deformable as compared to the lower-half flow guide 81 by a means other than the means of increasing the thickness. For example, examples of such a means include the means of coupling an upper-half flow guide to other members as in the above-described first and second embodiments, and the means of coupling an upper-half flow guide to a thermal insulating member as in the above-described third embodiment.

Note that in the first to fifth embodiments, the case of the upper-half flow guide being less deformed as compared to the lower-half flow guide has been described. However, the present invention is not limited to such an example. That is, the lower-half flow guide may be configured to be less thermally deformable as compared to the upper-half flow guide. In this case, the first protrusion is formed at the upper-half flow guide coupling portion to protrude, in the circumferential direction thereof, more on the side close to the rotor shaft 1 than on the side close to the steam flow path of the diffuser 14. Moreover, the second protrusion is formed at the lower-half flow guide coupling portion to protrude, in the circumferential direction thereof, more on the side close to the steam flow path of the diffuser 14 than on the side close to the rotor shaft 1.

REFERENCE SIGNS LIST

1 rotor shaft
2 outer chamber
5 axis
6 main flow path
7 moving blade
8 stationary blade
10 steam turbine
11 steam supply port
12 steam discharge chamber
14 diffuser
15 flow guide shaft-side space
16 flow guide
31 lower-half flow guide
32 upper-half flow guide
41 inner step portion
42 contact surface
43 outer step portion
44 contact surface
52 upper-half flow guide
56 outer step portion
57 contact surface
58 rib
62 upper-half flow guide
66 outer step portion
67 contact surface
68 partitioning plate
72 upper-half flow guide
76 partitioning plate
77 side wall
78 space
80 flow guide
81 lower-half flow guide
82 upper-half flow guide
85 inner protrusion
86 contact surface
88 outer protrusion
89 contact surface

The invention claimed is:

1. A steam turbine comprising:

a flow guide placed about a rotor shaft and forming a side wall of a diffuser close to the rotor shaft, wherein the flow guide is formed in such a truncated conical shape that a first portion having a semi-circular-arc cross section and a second portion having a semi-circular-arc cross section and exhibiting less thermal deformation than the first portion are combined together, a coupling portion of the first portion with the second portion has a first protrusion protruding, in a circumferential direction thereof, more on a rotor shaft side than on a steam flow path side of the diffuser, and a coupling portion of the second portion with the first portion has a second protrusion protruding, in a circumferential direction thereof, more on the steam flow path side of the diffuser than on the rotor shaft side and overlapping with the first protrusion in a radial direction of the flow guide.

2. The steam turbine according to claim 1, wherein a thickness of the second portion is greater than that of the first portion.

3. The steam turbine according to claim 1, further comprising:

a restraining member connected to an inner surface of the second portion on the rotor shaft side such that the second portion exhibits less thermal deformation than the first portion.

4. The steam turbine according to claim 3, wherein the restraining member has a planar member forming a space between the planar member and the second portion.

5. The steam turbine according to claim 1, further comprising:

a plurality of ribs arranged in a plane perpendicular to an axis of the rotor shaft to contact an inner surface of the second portion in the circumferential direction thereof, and connected to the second portion.

6. The steam turbine according to claim 1, further comprising:

a partitioning plate disposed inside the second portion so as not to contact the rotor shaft and so as to be parallel to a horizontal plane containing an axis of the rotor shaft, and connected to an inner surface of the second portion.

7. The steam turbine according to claim 6, further comprising:

a side wall connected in a manner such that the edge of the side wall contacts, in the circumferential direction thereof, the partitioning plate and an inner side of the second portion, a space surrounded by the second portion, the partitioning plate, and the side wall.

8. The steam turbine according to claim 1, wherein the first protrusion is provided with a first contact surface formed in a plane intersecting a horizontal plane containing an axis of the rotor shaft at a predetermined angle, the second protrusion is provided with a second contact surface formed to face the first contact surface.

* * * * *